US011054173B2

(12) United States Patent
Kuo et al.

(10) Patent No.: US 11,054,173 B2
(45) Date of Patent: Jul. 6, 2021

(54) WATER HEATER WITH ORGANIC POLYMER COATING

(71) Applicant: A. O. SMITH CORPORATION, Milwaukee, WI (US)

(72) Inventors: Ming C. Kuo, Fox Point, WI (US); Nathaniel Arnell Rose, Monroe, NC (US); Brittney Nicole Voss, Florence, SC (US); David Andrew Wallace, Florence, SC (US); Bandar M. Hamada, Stallings, NC (US); John L. Porter, IV, Johnson City, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 99 days.

(21) Appl. No.: 16/210,913

(22) Filed: Dec. 5, 2018

(65) Prior Publication Data

US 2019/0170394 A1 Jun. 6, 2019

Related U.S. Application Data

(60) Provisional application No. 62/595,385, filed on Dec. 6, 2017.

(51) Int. Cl.
*B65D 25/14* (2006.01)
*F24H 1/18* (2006.01)
(Continued)

(52) U.S. Cl.
CPC ..... *F24H 1/183* (2013.01); *F24H 9/148* (2013.01); *B05D 1/06* (2013.01); *B05D 7/227* (2013.01);
(Continued)

(58) Field of Classification Search
CPC . F24H 1/183; F24H 1/181; F24H 9/02; B65D 25/14; B65D 90/04; B65D 90/041; F22B 37/36
See application file for complete search history.

(56) References Cited

U.S. PATENT DOCUMENTS 2,428,526 A * 10/1947 Osterheld ..... F24H 1/183 204/196.16
2,842,840 A 7/1958 Ploetz
(Continued)

FOREIGN PATENT DOCUMENTS

CA 2114858 A1 8/1994
CN 2377490 Y 5/2000
(Continued)

OTHER PUBLICATIONS

Tiwari, "Clearing the confusion about the coating and material of the tank in water heaters," Bijli Bachao, <https://bijlibachao.com/water-heaters/coating-storage-water-heater-thermoplastic-stainless-steel-enamel-coating-glasslined.html> dated May 8, 2017.
(Continued)

*Primary Examiner* — Gregory A Wilson
(74) *Attorney, Agent, or Firm* — Michael Best & Friedrich LLP

(57) ABSTRACT

A method of constructing a water heater includes the steps of providing a tank having a metal interior tank wall and a heat exchanger positioned within the tank, coating the interior tank wall and the heat exchanger with a first layer comprising glass enamel, and coating a portion of the first layer with a second layer comprising an organic polymer to protect the portion of the first layer from exposure to water in the tank.

24 Claims, 4 Drawing Sheets

(51) Int. Cl.

| | |
|---|---|
| ***F24H 9/14*** | (2006.01) |
| *C23D 5/02* | (2006.01) |
| *C23D 5/00* | (2006.01) |
| *F24H 1/20* | (2006.01) |
| *B05D 1/06* | (2006.01) |
| *B05D 7/22* | (2006.01) |

(52) U.S. Cl.
CPC ..... *B05D 2202/00* (2013.01); *B05D 2350/60* (2013.01); *C23D 5/00* (2013.01); *C23D 5/02* (2013.01); *F24H 1/206* (2013.01)

(56) References Cited

U.S. PATENT DOCUMENTS

| | | | | |
|---|---|---|---|---|
| 3,207,358 | A | 9/1965 | Fliss | |
| 3,324,280 | A | 6/1967 | Cheney et al. | |
| 3,655,610 | A | 4/1972 | Vasta | |
| 4,099,641 | A | 7/1978 | Schiedat | |
| 4,150,164 | A | 4/1979 | Gerek et al. | |
| 4,191,304 | A | 3/1980 | Schiedat | |
| 4,263,499 | A | 4/1981 | Romance | |
| 4,296,799 | A | 10/1981 | Steele | |
| 4,313,400 | A | 2/1982 | Walker | |
| 4,879,801 | A | 11/1989 | Stubbe et al. | |
| 4,966,790 | A | 10/1990 | Iizuka et al. | |
| 4,981,112 | A * | 1/1991 | Adams | F24H 1/183 122/149 |
| 5,069,956 | A | 12/1991 | Murata et al. | |
| 5,217,140 | A * | 6/1993 | Lindahl | B29C 33/0016 220/4.06 |
| 5,501,012 | A | 3/1996 | Nogles | |
| 5,522,523 | A | 6/1996 | Nogles | |
| 5,728,423 | A | 3/1998 | Rogerson | |
| 5,855,747 | A * | 1/1999 | Lusk | C23F 13/00 204/196.19 |
| 6,061,499 | A | 5/2000 | Hlebovy | |
| 8,277,912 | B2 * | 10/2012 | Kuo | B05D 7/227 428/35.8 |
| 8,807,093 | B2 | 8/2014 | Steinhafel | |
| 9,044,779 | B2 | 6/2015 | Thompson et al. | |
| 9,657,398 | B2 | 5/2017 | Erickson et al. | |
| 10,240,814 | B1 * | 3/2019 | Lesage | C23D 5/04 |
| 2004/0034154 | A1 | 2/2004 | Tutin et al. | |
| 2004/0254328 | A1 | 12/2004 | Haraguchi et al. | |
| 2005/0003082 | A1 | 1/2005 | Roelofs et al. | |
| 2005/0048218 | A1 | 3/2005 | Weidman | |
| 2010/0269345 | A1 * | 10/2010 | DeArmey | F24H 1/205 29/890.051 |
| 2010/0281899 | A1 * | 11/2010 | Garrabrant | F24D 17/0036 62/238.1 |
| 2016/0221009 | A1 * | 8/2016 | Milli | B05B 5/032 |
| 2018/0051907 | A1 * | 2/2018 | Boros | F24H 9/2021 |

FOREIGN PATENT DOCUMENTS

| | | | | |
|---|---|---|---|---|
| CN | 1295921 | A | 5/2001 | |
| CN | 2526727 | Y | 12/2002 | |
| CN | 2532411 | Y | 1/2003 | |
| CN | 1431129 | A | 7/2003 | |
| CN | 2830967 | Y | 10/2006 | |
| CN | 201575598 | U | 9/2010 | |
| DE | 3407777 | A1 | 9/1985 | |
| DE | 4012643 | A1 | 12/1990 | |
| EP | 1428762 | A1 | 6/2004 | |
| EP | 1867400 | A1 * | 12/2007 | B05D 7/14 |
| EP | 1867400 | A1 | 12/2007 | |
| EP | 2245379 | B1 * | 9/2017 | F24H 1/183 |
| FR | 2506753 | A1 | 12/1982 | |
| GB | 1322084 | A | 7/1973 | |
| JP | 2003232595 | A | 8/2003 | |

OTHER PUBLICATIONS

International Search Report and Written Opinion for Application No. PCT/US2018/064096 dated Mar. 5, 2019 (14 pages).
Office Action issued by the China National Intellectual Property Administration for Application No. 201880085509.7 dated Apr. 22, 2021 (15 pages including English translation).

* cited by examiner

WATER HEATER WITH ORGANIC POLYMER COATING

CROSS-REFERENCE TO RELATED APPLICATIONS

This application claims priority to U.S. Provisional Patent Application No. 62/595,385 filed on Dec. 6, 2017, the entire contents of which are incorporated herein by reference.

BACKGROUND

The present invention relates to a water heater having a metal substrate, and more specifically to protecting the metal substrate by an organic polymer coating. Glass enamel coatings are traditionally used in hot water heaters to protect the metal substrate, but are subject to dissolution by hot water. Once the protective glass enamel coating has dissolved through to the substrate, then the substrate corrodes rapidly and is perforated through. At this point the water heater must be replaced.

SUMMARY

In one embodiment, the invention provides a method of constructing a water heater in the steps of providing a tank having a metal interior tank wall, a heat exchanger positioned within the tank, coating the interior tank wall and the heat exchanger with a first layer comprising glass enamel, and coating a portion of the first layer with a second layer comprising an organic polymer to protect the portion of the first layer from exposure to water in the tank.

In another embodiment, the invention provides a water heater including a metal interior tank wall and a heat exchanger positioned within the tank. A first layer is positioned on the interior tank wall and the heat exchanger. The first layer includes glass enamel. The water heater further includes a second layer positioned on a portion of the first layer. The second layer includes an organic polymer. The second layer is configured to protect the portion of the first layer from exposure to water in the tank.

Other aspects of the invention will become apparent by consideration of the detailed description and accompanying drawings.

DETAILED DESCRIPTION

Before embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
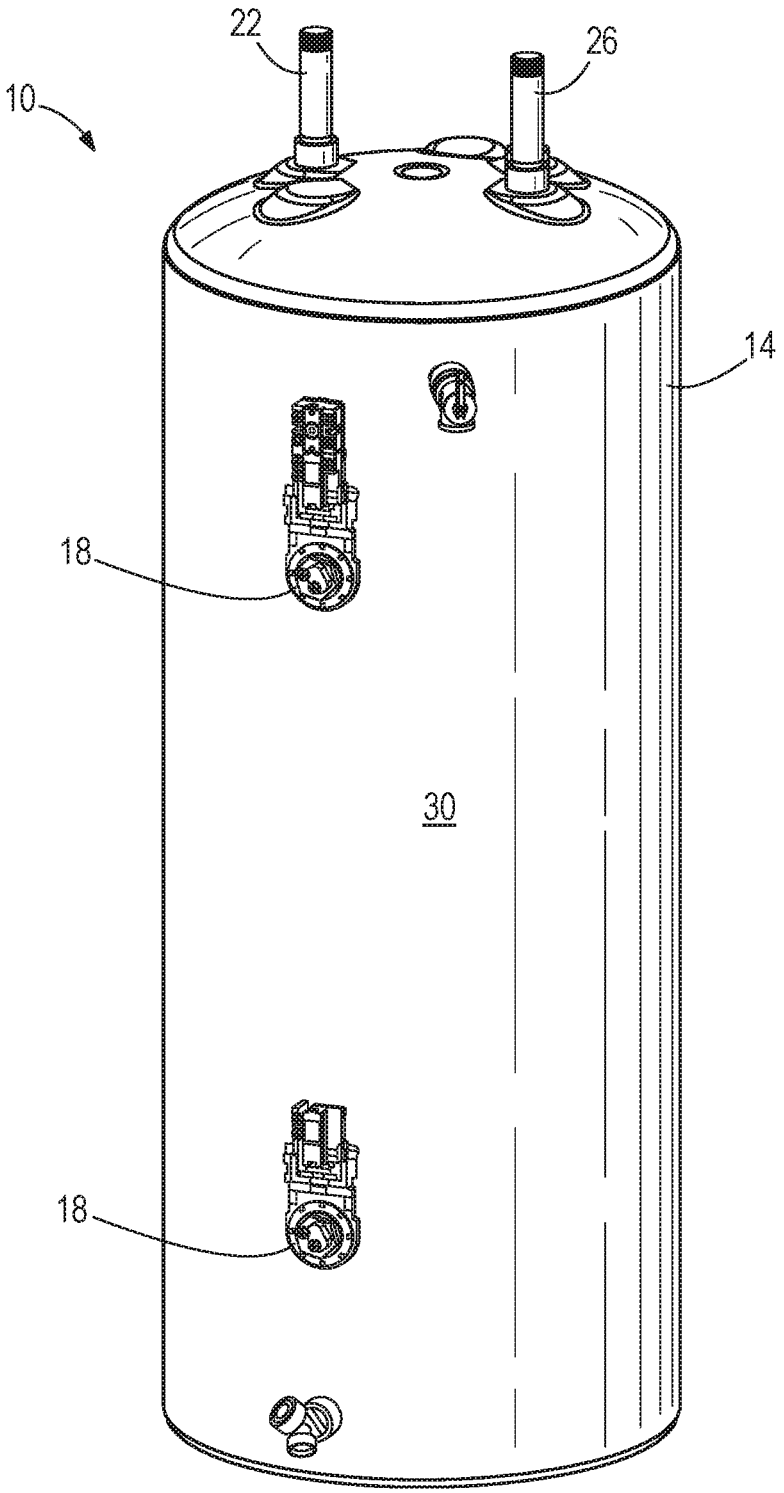
FIG. 1 is a perspective view of a water heater including a tank.

FIG. 1 illustrates a water heater 10 with portions not illustrated for clarity purposes. More specifically, the water heater 10 includes a tank 14 to hold water to be heated. The water heater 10 further includes a source of heat (e.g., electrical elements, condenser coil, burner, etc.) for heating the water in the tank 14. In the illustrated embodiment, the water heater 10 is an electrical water heater with electrical heating elements positioned within the tank 14. The electrical heating elements are electrically connected via fittings 18 that extend through a sidewall of the tank 14. The water in the tank 14 is generally heated and maintained in a range of 110 to 140 degrees Fahrenheit. A water inlet pipe 22 and a water outlet pipe 26 are coupled to and in fluid communication with an interior of the tank 14. The water inlet pipe 22 is used for supplying cold water to the tank 14 and the water outlet pipe 26 is used for drawing heated water from the tank 14. The water heater 10 may further include insulation (e.g., foam-in-place insulation or fiberglass batt insulation) around the tank 14 to reduce heat loss.

Figure 2:
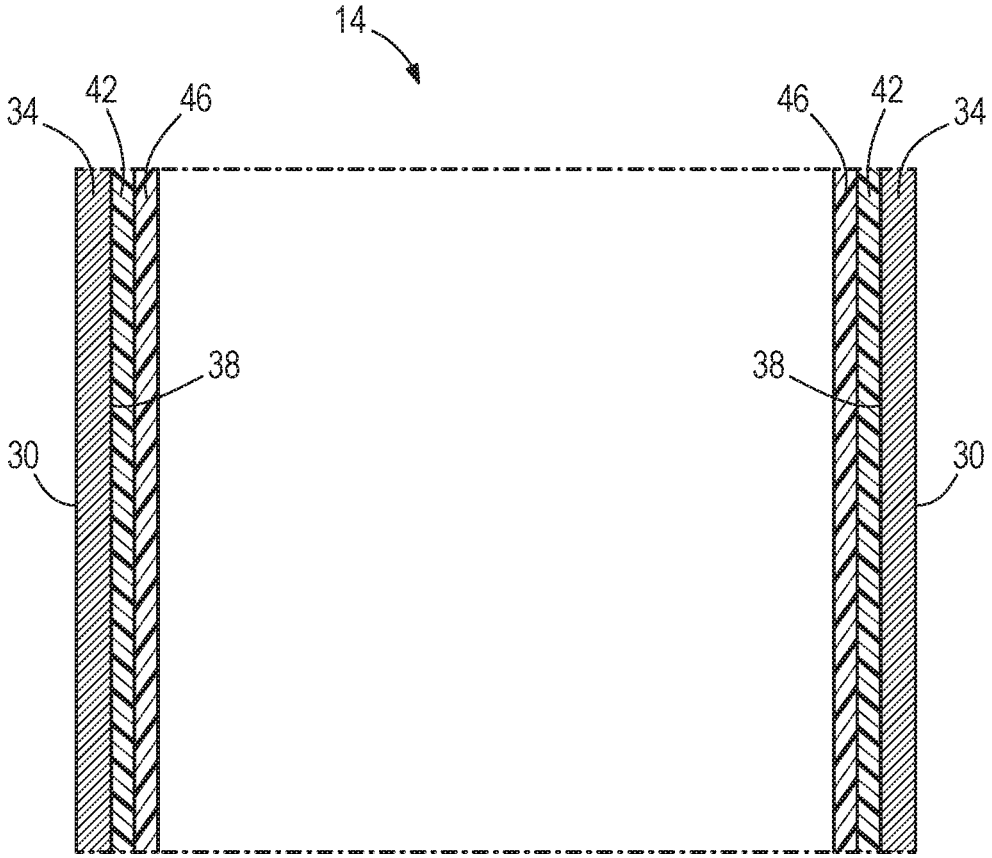
FIG. 2 is a cross-sectional schematic view of the tank of FIG. 1.

With reference to FIGS. 1 and 2, and the tank 14 includes a tank wall 34 having an outer surface 30 and an oppositely-facing interior surface 38 that defines an interior space of the tank 14. The tank wall 34 may be fabricated from a metal material such as steel. In addition, the interior surface 38 may be coated with a plurality of layers for inhibiting exposure of the interior tank wall 38 to water contained in the interior space of the tank 14. In the illustrated embodiment, the tank 14 includes a first layer 42 positioned on the interior surface 38 and a second layer 46 positioned on the first layer 42.

With reference to FIG. 2, the first layer 42 comprises glass enamel to protect the tank wall 34 from direct exposure to water which could lead to failure of the metal tank wall 34 due to corrosion or cracking. As such, the first layer 42 is configured to protect the interior surface 38 from the corrosive effects of direct exposure to the water in the tank 14. Glass enamel can be compromised when exposure to high temperatures (e.g., above a "water temperature limit"), high acidity (e.g., above a "water acidity limit"), or high alkalinity (e.g., above a "water alkalinity limit"). The water acidity limit and the water alkalinity limit may also be thought of as below and above, respectively, a glass enamel pH range (e.g., the pH range within the tolerance of the glass enamel). The term "compromised" may be defined as melting, dissolving, cracking, eroding, corroding, or any other kind of breakdown of the first layer 42.

In the exemplary construction, the glass enamel has a water temperature limit in the range of 131-208 degrees Fahrenheit (131-208° F.). In other exemplary constructions, the water temperature limit may be 160 degrees Fahrenheit (160° F.). In an exemplary construction, the water acidity limit may be a pH of 4 (i.e., the glass enamel may be compromised when exposed to a pH below 4). In an exemplary construction, the water alkalinity limit may be a pH of 10 (i.e., the glass enamel may be compromised when exposed to a pH above 10). Stated another way, the pH range for the glass enamel may be 4-10 (i.e., the glass enamel is at little or no risk of being compromised at a pH between 4-10, inclusive). As such, the second layer 46 forms a protective barrier on the first layer 42 (i.e., protecting the first layer 42 from direct exposure to water and high temperatures) for inhibiting the first layer 42 from being compromised due to water temperature, water acidity, or water alkalinity.

With reference to FIG. 2, the second layer 46 comprises an organic polymer as prescribed in U.S. Pat. No. 8,277,912, incorporated herein by reference. The second layer 46 is directly exposed to water in the tank 14 and protects the first layer 42 from direct exposure to the water. As such, the second layer 46 forms a protective barrier on the first layer 42 for slowing, inhibiting, or preventing the first layer 42 from being compromised. The second layer 46 may extend the amount of time it takes for the first layer 42 to be compromised. Consequently, the second layer 46 may prevent early failure of the tank 14 such that a life expectancy of the tank 14 may be prolonged.

The water heater 10 as described above may be constructed in a plurality of steps. A first step includes providing the tank 14 having the metal tank wall 34. This may include forming the tank 14 by fully assembling all components of the tank 14 and welding. When the tank 14 is formed, an opening for the water inlet pipe 22, an opening for the water outlet pipe 26, openings for draining, and openings for safety valves may be included. The interior surface 38 may be cleaned and blasted using abrasive particles. This may include cleaning and blasting all steel surfaces of the interior surface 38.

A second step includes coating the interior surface 38 with the first layer 42 comprising of glass enamel. This may include slush coating the interior surface 38 with the first layer 42. The second step may include applying the first layer 42 in powder form as glass powder. The second step may include wetting the powder to form a wet mixture called a "slip." The second step may further include slushing the slip (i.e., slip-slushing) onto the interior surface 38. This may include slushing the slip on all of the steel surfaces by rotating the tank 14. The second step may further include heating and curing the slip after it has been applied to the interior surface 38. This may include drying the slip for at least 20 minutes at a temperature of at least 400 degrees Fahrenheit (400° F.). The first layer 42 may then be heated by firing in the furnace (i.e., furnace firing) to bond the first layer 42 to the interior surface 38. The first layer may be furnace fired at a temperature in the range of 1500 to 1600 degrees Fahrenheit (1500-1600° F.) or a temperature of at least 1500 degrees Fahrenheit (1500° F.) for a period of 5 to 10 minutes.

A third step includes providing the organic polymer of the second layer 46 in powder form, positioning the organic polymer powder on the first layer 42, and heating the second layer 46. More specifically, the organic polymer powder may be electrostatically sprayed onto the first layer 42 by positively charging the organic polymer powder prior to the powder leaving the sprayer and grounding the tank 14 such that the powder is attracted to the interior surface 38 of the grounded tank 14. Subsequently, the organic polymer powder is heated in an oven at a temperature in the range of 400 to 420 degrees Fahrenheit (400-420° F.) for at least 20 minutes to form the second layer 46. In one construction, the second layer 46 has a thickness of at least 4 Mils (i.e., 101.6 Micrometers).

Figure 3:
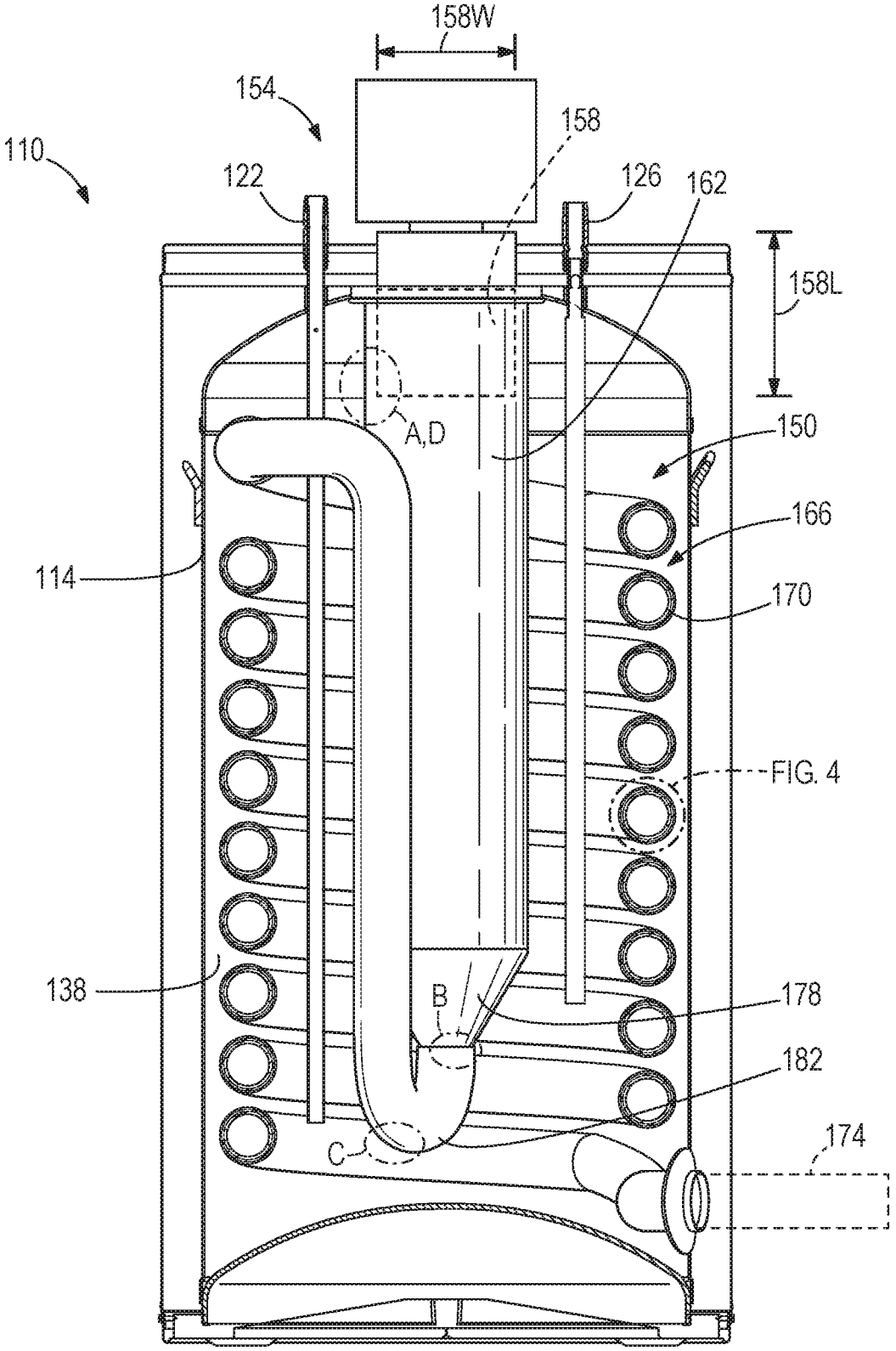
FIG. 3 is a cross-sectional side view of another water heater embodying the invention.

FIG. 3 illustrates another water heater 110 embodying the invention, with like components and features as the embodiment of the water heater 10 shown in FIGS. 1-2 being labeled with like reference numerals plus "100". The water heater 110 includes a tank 114, a water inlet pipe 122, and a water outlet pipe 126. The water heater 110 further includes a combustor 154 (shown schematically in FIG. 3). The combustor 154 includes a gas burner 158 and a combustion chamber 162. A flue 166 is positioned in the tank 114 and is in fluid communication with the combustion chamber 162. Hot flue gases are generated by the gas burner 158 burning a combustible mixture of fuel (e.g., gas) and air within the combustion chamber 162. The hot flue gases are then directed from the combustion chamber 162 through the flue 166 to a flue gas outlet 174. In the illustrated embodiment, the burner 158 fires downwardly into the combustion chamber 162 and may therefore be termed as a down-firing burner.

The water heater 110 includes high heat flux regions. In particular, the term "high heat flux region" is used to indicate a portion of the water heater 110 having special characteristics disclosed herein that experiences high heat which can lead to accelerated corrosion.

Referring to FIG. 3, examples of high heat flux regions are regions that meet one or more of the following criteria: locations with line-of-sight contact to the burner, due to high flame temperatures or radiation heat transfer from the burner ("line-of-sight regions" indicated with "A"); transition locations from a larger chamber or tube to a smaller chamber or tube, due to a reduction in boundary layer thickness and some minor increases in turbulence resulting from an increase in velocity of the gas ("transition regions" indicated with "B"); elbows or bends resulting in high heat flux due to increased gas turbulation and reduction of the boundary layer thickness adjacent portions of the elbow ("elbow regions" indicated with "C"); and locations within approximately three burner lengths or widths from the burner 158, resulting in high heat flux due to high gas temperature ("proximal regions" indicated with "D").

"Line-of-sight" means there is an unobstructed path between the source of heat and the region, such that the region is exposed to radiant heat from the heat source. An example of a line-of-sight region A is the sidewall of the combustion chamber 162 alongside the lower end of the burner 158 in FIG. 3. An example of a transition region B is the transition from a narrowing portion 178 of the combustion chamber 162 to an elbow 182 in FIG. 3. In addition, an example of an elbow region C is the elbow 182.

For the purposes of finding a proximal region, the term "burner length" may mean the major dimension of the burner and "burner width" may mean the minor dimension of the burner. In the illustrated constructions, the burner has a burner length 158L and a burner width 158W. Proximal regions experience high heat flux because the temperature of the products of combustion is highest close to the burner. Examples of proximal regions D are the portions of the combustion chambers 162 near the portion of the burner 158. The high heat flux regions A-D are not mutually exclusive. A region may qualify as a high heat flux region under multiple categories. For example, a line-of-sight region A is often also going to be a proximal region D.

The combustion chamber 162 and the flue 166 are heated by the hot flue gases produced by the gas burner 158, and the heat is transferred to the water within the tank 114. Therefore, the combustion chamber 162 and the flue 166 may be defined as a heat exchanger 150 of the water heater 110.

Similar to the water heater 10 of FIGS. 1-2, an inner surface 138 of the tank 114 is exposed to the water within the tank 114. Furthermore, an outer surface 170 of the heat exchanger 150 (i.e., an outer surface of the combustion chamber 162 and an outer surface of the flue 166) is also exposed to the water within the tank 114 such that the inner surface 138 of the tank 114 and the outer surface 170 of the heat exchanger 150 may be termed "water-facing surfaces". The water in the tank 114 is in contact with the water-facing surfaces (or more technically, with coatings 142, 146 on the water-facing surfaces, as further discussed below).

Figure 4:
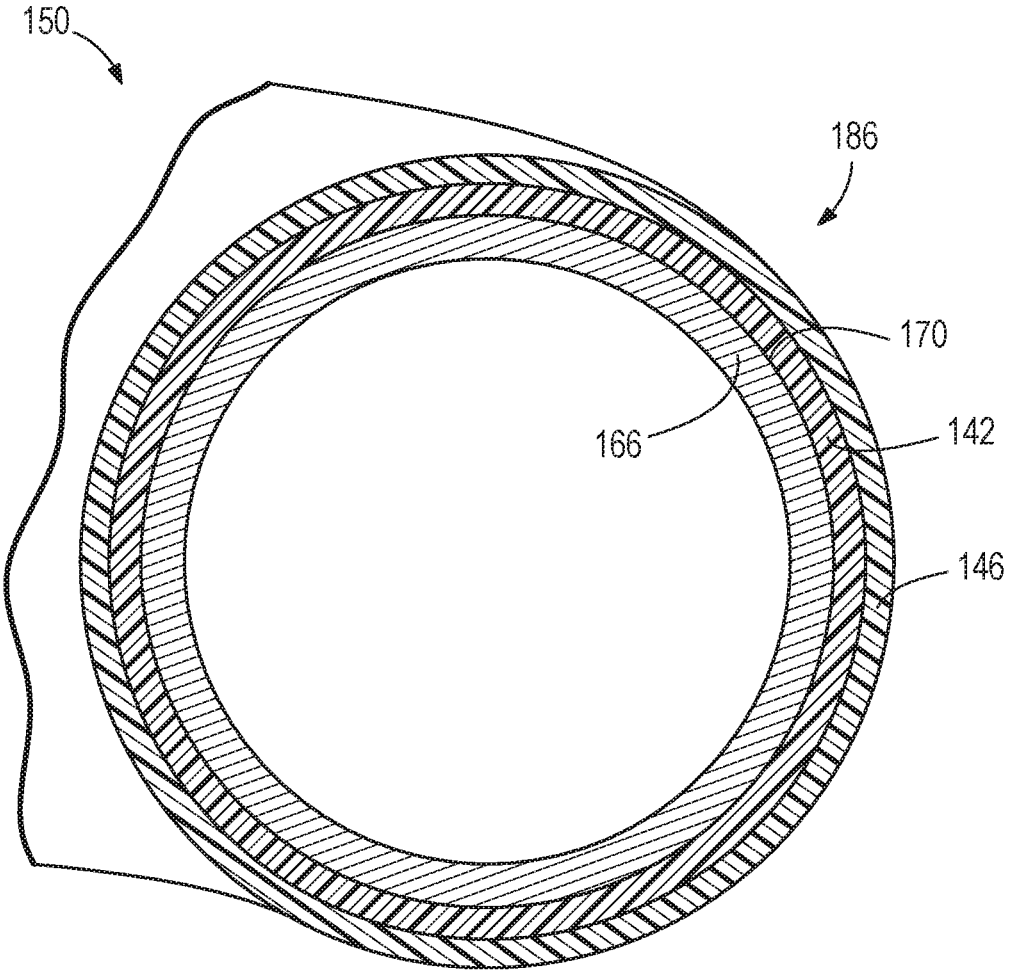
FIG. 4 is an enlarged cross-sectional view of a heat exchanger coil of the water heater of FIG. 3.

The interior surface 138 of the tank 114 and/or the outer surface 170 of the heat exchanger 150 may be coated with a plurality of layers for inhibiting exposure of the water-facing surfaces to the water contained in the interior space of the tank 114. As shown in FIGS. 3 and 4 of the illustrated embodiment, the heat exchanger 150 includes a first layer 142 positioned on the outer surface 170 and a second layer 146 positioned on the first layer 142. In other embodiments, the interior tank 114 (or portions thereof) may also include the first layer 142 positioned on the interior surface 138, and the second layer 146 positioned on the first layer 142 (similar to the first embodiment of FIGS. 1 and 2). The first and second layers 142, 146 may be positioned on the heat exchanger 150 and/or the tank 114 based on one or more of a predetermined (i.e., expected) water temperature range, the performance trying to be achieved, the application of the water heater 110, and a lifetime of the water heater 110.

The first layer 142 comprises glass enamel and the second layer 146 comprises an organic polymer, as described above with respect to the first embodiment. In particular, the first layer 142 is configured to protect the heat exchanger 150 from direct exposure to water which could lead to failure of the metal heat exchanger 150 due to corrosion or cracking. The glass enamel can be compromised (i.e., when exposure to high temperatures such as high water temperature, high acidity, and high alkalinity). The second layer 146 forms a protective barrier on the first layer 142 (i.e., protecting the first layer 142 from direct exposure to water and high temperatures) for inhibiting the first layer 142 from being compromised such as due to exposure of water, water temperature, water acidity, or water alkalinity.

In particular, the first and second layers 142, 146 are positioned on the high heat flux regions of the heat exchanger 150 (although the first and second layers 142, 146 may also be positioned on other portions or all of the heat exchanger 150 and or the interior surface 138 of the tank 114). The portions of the heat exchanger 150 having the high heat flux regions may compromise the fastest. The second layer 146 is positioned on the first layer 142 in particular at these high heat flux regions to slow, inhibit, or prevent the first layer 142 from being compromised.

With reference to FIG. 3, the water heater 110 may be constructed in a plurality of steps. A first step includes providing the tank 114 having the metal tank wall 134. This may include forming the tank 114 by fully assembling all components of the tank 114 and welding. Specifically, in this embodiment, the metal heat exchanger 150 is positioned within the tank 114. When the tank 114 is formed, an opening for the water inlet pipe 122, an opening for the water outlet pipe 126, openings for the flue gas outlet 174, openings for draining, and openings for safety valves may be included. The interior surface 138 may be cleaned and blasted using abrasive particles. This may include cleaning and blasting all steel surfaces of the interior surface 138.

A second step includes coating the interior surface 138 of the tank 114 and the outer surface 170 of the heat exchanger 150 with the first layer 142 comprising of glass enamel. This may include slush coating the interior surface 138 as described above with respect to the water heater 10 of the first embodiment, but also slush coating the heat exchanger 150 with the first layer 142. The second step may include applying the first layer 142 in powder form as glass powder. The second step may include wetting the powder to form a wet mixture called a "slip." The second step may further include slushing the slip (i.e., slip-slushing) onto the interior surface 138 and the heat exchanger 150. This may include slushing the slip on all of the steel or metal surfaces (including the heat exchanger 150) by rotating the tank 114. The second step may further include heating and curing the slip after it has been applied to the interior surface 138 and the heat exchanger 150. This may include drying the slip for at least 20 minutes at a temperature of at least 400 degrees Fahrenheit (400° F.). The first layer 142 may then be heated by firing in the furnace (i.e., furnace firing) to bond the first layer 142 to the interior surface 138 and to the heat exchanger 150. The first layer 142 may be furnace fired at a temperature in the range of 1500 to 1600 degrees Fahrenheit (1500-1600° F.) or a temperature of at least 1500 degrees Fahrenheit (1500° F.) for a period of 5 to 10 minutes.

In particular, the water-facing surfaces of the water heater 110 are lined or coated with the glass enamel of the first layer 142 to reduce susceptibility to corrosion in the second step. Furthermore, bubbles may form within the first layer 142 during the furnace firing due to carbon dioxide within the slip pushing out as the first layer 142 is heated. Specifically, these bubbles may form near the surface of the first layer 142 opposite the outer surface 170 of the heat exchanger 150 or opposite the interior surface 138 of the tank 114. The bubbles may form an interconnected bubble structure within the first layer 142.

A third step includes providing the organic polymer of the second layer 146 in powder form, positioning the organic polymer powder on the first layer 142, and heating the second layer 146. More specifically, the organic polymer powder may be electrostatically sprayed onto the first layer 142 by positively charging the organic polymer powder prior to the powder leaving the sprayer and grounding the tank 114 such that the powder is attracted to the interior surface 138 of the grounded tank 114 and to the heat exchanger 150 positioned within the tank 114.

In one example, the organic polymer powder may be electrostatically sprayed using a Tribo powder coating gun. In this example, the Tribo powder coating gun is inserted into one of the openings provided in the tank 114 that fluidly connect to the inlet pipe 122, the outlet pipe 126, the flue gas outlet opening, or a drain opening (not shown). For example, the Tribo powder coating gun is inserted in the water inlet pipe opening and an end of the Tribo powder coating gun is positioned proximate a bottom of the heat exchanger. The Tribo powder coating gun subsequently begins spraying from the bottom of the heat exchanger 150 to a top of the heat exchanger 150. The Tribo powder coating gun may electrostatically spray for about two minutes. The organic polymer powder is applied to the first layer 142 positioned on the interior surface 138 of the tank 114 and the heat exchanger 150. The tank 114 forms an enclosure such that there is no need to control the direction of spraying of the organic polymer powder. In the illustrated embodiment, the enclosure has a cylindrical shape.

In particular, the organic polymer powder is directed toward a coil of the heat exchanger 150 by the Tribo powder coating gun. Therefore, the organic polymer powder may be applied to only certain portions of the first layer 142 positioned on the interior surface 138 of the tank 114 as the organic polymer powder is being electrostatically sprayed toward the heat exchanger 150. In other words, portions of the interior surface 138 of the tank 114 may not be electrostatically sprayed with the organic polymer powder of the second layer 146.

The third step further includes heating the organic polymer powder. In one construction, the organic polymer powder is heated in an oven at a temperature in the range of 400 to 420 degrees Fahrenheit (400-420° F.) for at least 20 minutes to form the second layer 146. The third step may further include allowing the tank 114 and/or the first layer 142 to cool to 120 degrees Fahrenheit (120° F.) prior to applying the second layer 146. In one construction, the second layer 146 has a thickness of at least 4 Mils (i.e., 101.6 Micrometers).

It is believed to be difficult for an organic polymer to adhere to a layer comprised of glass enamel due to the hardening of the glass enamel when forming the first layer 142. It is unsure why, in the construction of the water heaters 10, 110 described above, an increase in the adhesion of the second layer 46, 146 to the first layer 42, 142 is achieved. One possibility that is considered is that during heating of the organic polymer powder in the third step, the bubbles near the surface of the first layer 42, 142 may break, become damaged, or otherwise be compromised by the organic polymer powder melting on the bubbles. The organic polymer powder may melt into the voids or recessed areas where the bubbles were, which may provide a better hold for the second layer 46, 146 thereby increasing the adhesion of the second layer 46, 146 to the first layer 42, 142. In other words, the heating in the third step is believed to compromise the first layer 42, 142 a minimum amount (only where the second layer 46, 146 is applied, and only at the surface of the first layer 42, 142 where the bubbles are formed) such that the second layer 46, 146 may better adhere to the first layer 42, 142. Therefore, despite the first layer 42, 142 being minimally compromised, the process actually appears to achieve better protection of the first layer 42, 142 from corrosion by allowing adhesion or an increase in adhesion of the second layer 46, 146 to the first layer 42, 142. Another possibility that is considered for the increased adhesion, in particular with respect to the water heater 110, is that, although the coil of the heat exchanger 150 includes multiple bends and curves such that the applying of the second layer 146 in powder form may be difficult to cover the total surface area of the coil, the organic polymer powder may meet up or join with, during heating, nearby organic polymer powder positioned on other portions of the bends and curves to form a sleeve 186 (FIG. 4). This allows portions of the second layer 146 to adhere to other portions of the second layer 146 which may also or further increase the adhesion of the second layer 146 to the first layer 142 on the heat exchanger 150. Therefore, surprising and unexpected results of an increase in adhesion of the organic polymer of the second layer 146 to the glass enamel of the first layer 142 is achieved.

Furthermore, the process allows the second layer 146 to be specifically applied to the high heat flux regions of the heat exchanger 150. In particular, the high heat flux regions are at the highest temperature with respect to other portions of the water heater 110 when the water heater 110 is operating as described above. In addition, the high heat flux regions are also exposed to the water within the tank 114. As such, the likelihood of failure of the heat exchanger 150 at these high heat flux regions may increase. The second layer 146 provided on the heat exchanger 150 in particular at the high heat flux regions may slow, inhibit, or prevent the first layer 142 on the heat exchanger 150 from being compromised. More specifically, the second layer 146 may extend the amount of time it takes for the first layer 142 to be compromised. Consequently, the second layer 146 may prevent early failure of the heat exchanger 150 such that a life expectancy of the water heater 110 may be prolonged.

Various features and advantages of the invention are set forth in the following claims.

What is claimed is:

1. A method of constructing a water heater comprising the steps of:

(a) providing a tank having a metal interior tank wall and a heat exchanger positioned within the tank;

(b) after step (a) coating the interior tank wall and the heat exchanger with a first layer comprising glass enamel and forming bubbles proximate a surface of the first layer while coating the interior tank with the first layer;

(c) after step (b) coating a portion of the first layer with a second layer comprising an organic polymer to protect the portion of the first layer from exposure to water in the tank, heating the second layer such that the bubbles are compromised, thereby creating recessed areas within the first layer, and melting the second layer into the recessed areas.

2. The method of claim 1, wherein step (b) includes slip-slushing the first layer onto the interior tank wall and the heat exchanger.

3. The method of claim 1, wherein step (b) includes drying the first layer for at least 20 minutes at a temperature of at least 400 degrees Fahrenheit.

4. The method of claim 1, wherein step (b) includes heating the first layer by firing in a furnace.

5. The method of claim 1, wherein step (b) includes heating the first layer at a temperature in the range of 1500 to 1600 degrees Fahrenheit for a period of 5 to 10 minutes.

6. The method of claim 1, wherein the second layer includes the organic polymer in powder form, and wherein step (c) includes electrostatically spraying the second layer onto the portion of the first layer.

7. The method of claim 6, wherein the second layer is electrostatically sprayed using a Tribo powder coating gun.

8. The method of claim 1, wherein step (c) includes heating the second layer at a temperature in the range of 400 to 420 degrees Fahrenheit for at least 20 minutes.

9. The method of claim 1, wherein step (c) includes forming a protective barrier with the second layer to inhibit the portion of the first layer from being compromised.

10. The method of claim 1, wherein step (c) includes using the second layer to inhibit dissolution of the portion of the first layer due to at least one of a predetermined water temperature limit, a predetermined acidic water limit, and a predetermined alkaline water limit.

11. The method of claim 1, wherein the portion of the first layer includes the first layer positioned on the heat exchanger.

12. The method of claim 1, wherein the heat exchanger includes regions having a high heat flux, and wherein the portion of the first layer includes the first layer positioned on the high heat flux regions.

13. The method of claim 1, wherein the portion of the first layer that is coated by the second layer includes the first layer that is positioned on a portion of the metal interior tank wall.

14. The method of claim 1, wherein compromising the bubbles is performed by the heated second layer.

15. A water heater comprising:

a tank including a metal interior tank wall;

a heat exchanger positioned within the tank;

a first layer positioned on the interior tank wall and the heat exchanger, the first layer including glass enamel having bubbles proximate a surface of the first layer; and a second layer positioned on a portion of the first layer, the second layer including an organic polymer, wherein the second layer is configured to protect the portion of the first layer from exposure to water in the tank and is configured to be heated such that the bubbles are compromised to create recessed areas within the first layer, and wherein the second layer is configured to be received into the recessed areas.

16. The water heater of claim 15, wherein the first layer is slip-slushed onto the interior tank wall and the heat exchanger, and wherein the first layer is furnace fired before the second layer is positioned on the portion of the first layer.

17. The water heater of claim 15, wherein the second layer includes the organic polymer in powder form, and wherein the second layer is electrostatically sprayed onto the portion of the first layer.

18. The water heater of claim 17, wherein the second layer is electrostatically sprayed using a Tribo powder coating gun.

19. The water heater of claim 15, wherein the second layer is configured to protect the portion of the first layer from dissolution due to at least one of a predetermined water temperature limit, a predetermined acidic water limit, and a predetermined alkaline water limit.

20. The water heater of claim 15, wherein the second layer forms a protective barrier to inhibit the portion of the first layer from being compromised.

21. The water heater of claim 15, wherein the portion of the first layer includes the first layer positioned on the heat exchanger.

22. The water heater of claim 15, wherein the heat exchanger includes regions having a high heat flux, and wherein the portion of the first layer includes the first layer positioned on the high heat flux regions.

23. The water heater of claim 15, wherein the portion of the first layer that is coated by the second layer includes the first layer that is positioned on a portion of the metal interior tank wall.

24. The water heater of claim 15, wherein the bubbles are compromised by the heated second layer.

* * * * *